US005882262A

United States Patent [19]

Ballhorn

[11] Patent Number: 5,882,262

[45] Date of Patent: Mar. 16, 1999

[54] PROGRAM-CONTROLLED ENTERTAINMENT AND GAME DEVICE

[75] Inventor: Karsten Ballhorn, Dalberg, Germany

[73] Assignee: NSM Aktiengesellschaft, Bingen, Germany

[21] Appl. No.: 615,327

[22] PCT Filed: Sep. 15, 1994

[86] PCT No.: PCT/DE94/01088

§ 371 Date: Jun. 10, 1996

§ 102(e) Date: Jun. 10, 1996

[87] PCT Pub. No.: WO95/08156

PCT Pub. Date: Mar. 23, 1995

[30] Foreign Application Priority Data

Sep. 15, 1993 [DE] Germany ..... 43 31 258.6

[51] Int. Cl.[6] ..... A63F 9/22

[52] U.S. Cl. ..... 463/43

[58] Field of Search ..... 463/1, 5, 23, 25, 463/30, 31, 35, 37, 39, 40, 41, 42, 43, 44

[56] References Cited

U.S. PATENT DOCUMENTS

| | | | |
|---|---|---|---|
| 4,516,777 | 5/1985 | Nikora . | |
| 4,572,509 | 2/1986 | Sitrick . | |
| 4,756,528 | 7/1988 | Umashankar | 463/1 |
| 4,922,420 | 5/1990 | Nakagawa et al. . | |
| 5,078,399 | 1/1992 | Lennon, Jr. . | |
| 5,393,071 | 2/1995 | Best | 463/35 |
| 5,413,357 | 5/1995 | Schulze et al. | 463/5 |
| 5,553,864 | 9/1996 | Sitrick | 463/31 |

FOREIGN PATENT DOCUMENTS

| | | |
|---|---|---|
| 0253751 | 1/1988 | European Pat. Off. . |
| 0431724 | 6/1991 | European Pat. Off. . |
| 0501456 | 9/1992 | European Pat. Off. . |
| 42173425 | 8/1983 | Germany . |
| 4222110 | 1/1994 | Germany . |
| 42441983 | 6/1994 | Germany . |
| 2239810 | 7/1991 | United Kingdom . |
| 2253931 | 9/1992 | United Kingdom . |
| 2268670 | 1/1994 | United Kingdom . |
| 93/14843 | 8/1993 | WIPO . |
| 93/23125 | 11/1993 | WIPO . |

*Primary Examiner*—George Manuel
*Attorney, Agent, or Firm*—Venable; George H. Spencer; Allen Wood

[57] ABSTRACT

A programmable game machine has a housing, a display unit (4) linked to the housing, preferably mounted therein, control elements (6) associated to the housing, a control unit (16) provided in the housing, and a memory device (36, 38) associated with the housing in which program and data information is stored. The game machine is preferably used as a coin-operated game machine, as a prize-giving game machine, or as a game of skill. The memory device (36, 38) preferably includes a memory unit for replaceably storing games, with only one game at a time being stored in the memory unit. The game machine may be linked to a server which supplies games for storage in the memory unit.

30 Claims, 3 Drawing Sheets

PROGRAM-CONTROLLED ENTERTAINMENT AND GAME DEVICE

BACKGROUND OF THE INVENTION

The invention relates to a program-controlled entertainment and game device.

Recently computers have become more and more commonly used. To achieve maximum versatility, diverse storage media have been developed for programs and data, for example, magnetic disks, diskettes, so-called compact disks, programmable storage parts such as EPROMS, etc.

Conventionally, programs are stored for example in EPROMS, where they can be modified according to circumstances. The memory space in EPROMS is however quite limited, so that the magnitude of the programs which can be stored in them is not suitable for all applications.

The demands on data and program storages have grown more and more. As personal computers continue to become more and more common, more and more applications are being transferred to them. But this means that all kinds of programs must run on personal computers.

In order to be able to simultaneously playback video and audio information, especially when it contains large amounts of data, other storage and output media have therefore been developed. They are so-called CDI-disks on which, according to the so-called CDI standard, data of this type can all be digitally stored. CDI disks can thus contain program and data information at the same time, in which the pertinent program information allows access to the corresponding data and interactive control operation is enabled. Since this can take place in real time operation, there are a host of applications. It becomes possible to read video, audio and program information at the instant of access from the disk, to buffer it, and then display it as an interactive program. In this way it is possible to switch back and forth between diverse program and data structures without losing time.

To enable versatile and interesting game operation, in an older German application (Ser. No. 42 22 110.2, corresponding to U.S. Pat. No. 5,413,357) of the assignee a program-controlled entertainment and game device with a playback unit for a CDI disk on which the program and data information is stored was proposed. Use of the device is determined by the program stored permanently in the CDI disk and the device can be configured entirely according to requirements in terms of function. The CDI disk makes it possible to have the game run with unexpectedly extensive alternations. Different game functions can be interactively selected and combined with one another at extremely high speed. Furthermore, in the selection of a certain function and the immediately succeeding display from it, additional game functions can in turn be selected. In this way it is possible to jump from one game level to the next, of course jumps from and into the different levels being possible alternatively at any time. The game possibilities are thus increased to an extraordinary degree compared to conventional entertainment and game devices.

In the area of music playback devices a music playback system has already been developed which comprises a central computer with a memory for at least one music playback unit, the music playback units being interconnected and connected to the central computer via a long distance data transmission line. The memory can thus be organized such that it is located decentrally distributed among the different music playback units. Preferably an ISDN line is used as the long distance data transmission line.

To improve the operating properties and to increase the ease of operation, especially information devices with a screen, with a control console, and with a housing have been developed in which an individually operator-oriented arrangement of the screen and controls is enabled. For this reason the control console is made as an independent control board which is positioned in ground-side guide elements to be an adjustable distance from the display CRT. The tilt of the housing with the screen can be adjusted. This embodiment enables the operator to assume an optimum sitting position with a simultaneously favorable screen tilt. The distance to the screen can thus meet physical requirements; at the same time the controls can be ergonomically arranged. In this way the pertinent device can be operated without fatigue over a longer time interval.

To facilitate operation of the device and to improve clarity, large screen projection arrangements have been developed for entertainment devices which make it possible to make the operating and control capabilities of the device more diverse and with greater inducement to play, so that the entertainment value is increased. For this reason an image pick-up means which encompasses the game field, a projector connected to the means, and a projection wall are provided onto which the recorded image of the game field can be projected. The enlarged projected image can be exactly followed by one or more players. Joint playing by several individuals on one device is greatly facilitated in this way. Besides the players active at the time, those not participating in the game can follow its progress without hindering the players and can give instructions and advice to the players. It has been proposed that a control board be assigned to an entertainment device operating with projection; the board has the same actuating elements as the actual entertainment device. In this case it will be possible to display individual areas of the game field by key control or computer control in a large or small format. Furthermore simultaneous projection of different game fields is provided. The interplay of several players with and against one another is promoted thereby.

Furthermore some game devices, especially video devices, are installed with different boards, by which they each contain programs and data for different games. By changing from one board to another the pertinent game with another version or a different game can be selected. It has proven very disadvantageous in these game devices that an entertainment tax rate increased by a factor corresponding to the number of boards must be paid. This cost increase makes the game devices uneconomical, so that they have not become popular.

SUMMARY OF THE INVENTION

The object of the invention is to devise an entertainment and game device which enables versatile and diverse game operation.

This object is achieved according to the invention in a program-controlled entertainment and game device with a memory means that can be reprogrammed each time for storage of program and data information for the respective function configuration, only one game being stored at a time in the entertainment and game device.

A program-controlled entertainment and game device according to the invention comprises a housing, a display which is connected to the housing or which is provided in it, especially a screen, the controls assigned to the housing, a control unit provided in the housing, and a memory means which is assigned to the housing and in which the program and data information are stored.

The advantage of the program-controlled entertainment and game device according to the invention consists in that use of the device is determined by the program stored in the memory means at the time. In this way it is possible to match the program-controlled entertainment and game device entirely to requirements with respect to function by reading in and storing new program and data information according to the situation. This re-storing processes results in the properties of the game device changing, i.e., for example a different game version can be played. Reading in an entirely different program or game can completely alter the function of the game device. If for example the game device was initially a money game, it can then be entirely a game of skill, as desired. The hardware components of the device such as the housing, display, controls, control unit and the memory means with variable storage contents in which the different games are stored are common to these entirely different devices.

More in particular, with each game newly read in, the entertainment and game device always equipped with the same basic units acquires different game functions. They however also act optically, since in the case of a money gaming device for example risk ladders, turntables, special game means, etc, are imaged on the display. If the multi-game device according to the invention then becomes a skill game device such as a shooting simulator or dart game, a completely different display with target area and hit display and the like arises. For the player, in practice it is then a new game device with entirely different game rules and properties.

In this way with the entertainment and game device according to the invention it is possible to play with extreme variety. Different game versions and games or hardware functions can be selected by each respective player from the available reservoir. The game possibilities are thus greatly enhanced compared to conventional entertainment and game devices such as money gaming devices or skill game devices, etc. The entertainment and game device according to the invention combines these functions in itself and also has the advantage that the entertainment tax does not accumulate, since only one game is stored in the device at a time.

In the entertainment and game device according to the invention the memory means is advantageously connected to the housing, preferably made integrated with it, yielding a compact equipment structure.

Feasibly the memory unit comprises a hard disk. Alternatively or additionally one or more CD-ROMS can be provided as the data media in the housing. To quickly change the CD-ROM it is a good idea if a CD-ROM magazine is provided for storing and reading the data media.

One or more EPROMs can also be provided as the memory means. The game event can be integrated into the respective device via these EPROMs.

According to another version of the program-controlled entertainment and game device according to the invention the device has a diskette drive. Then diskettes can be simply transported and exchanged to change games, by which data exchange can be made very flexible.

In one preferred embodiment of the program-controlled entertainment and game device according to the invention the device is connected to a long distance data transmission line, in which the received data can be stored for example on the hard disk. In this way game operation can be made especially flexible. The data can be exchanged for example by the installer, alternatively however also by the user, i.e., the player. If for example the installer sees that the frequency of use of the pertinent game device is clearly diminishing, he need simply replace the stored game by another game in which there seems to be greater interest using a command and corresponding read-in of new game data.

These data exchanges can of course take place at the desired time and are fundamentally not linked to game operation, i.e., data are not usually transmitted on line.

Advantageously the program-controlled entertainment and game device can be connected to a network, in which preferably there is a server for control of the device or of a network assigned to the device.

Another flexible configuration of the program-controlled entertainment and game device according to the invention arises by assigning or connecting the device to an evaluation unit. In this way for example the frequencies of use and selection processes can be automated with regard to games to be newly read in.

A keyboard and/or mouse, as for a personal computer, can be provided as controls. A joystick or laser beam can also be used. Alternatively or additionally a control keyboard or controls can also be attached on the screen, like a touch-screen. Furthermore a touch panel, i.e., a matrix of optical transmitters/receivers which acquire the interruption of a light beam can be provided. In this way the player can subjectively intervene directly into the game by being active with his hands on the game field.

One advantageous embodiment of the entertainment and game device according to the invention comprises a control board which can also be provided in addition. Furthermore it is also possible to play using a remote control unit. In another preferred embodiment of the invention the controls are made at least partially voice-controlled.

In order to enable game operation with inclusion of several players or even a third individual who is not playing, the display unit advantageously comprises a large screen projection unit or TV screen to which is assigned preferably a control board assigned to the device.

There is preferably a means by which at least individual areas of the display can be selected by computer control and can be displayed in a large or a small format. This greatly facilitates game operation. The player then moreover sees only the display and control functions of interest at the moment by emphasis in the game areas currently in use, by which he can concentrate much more than conventionally on playing the game.

In order to illustrate the different function areas and game levels, simultaneous representation of several displays on the display unit is advantageously possible. In this way the player can on the one hand survey the game area in use at the instant. On the other hand, he can also examine other game areas which will shortly be of interest to him, for example.

To jump into the different game levels and to better survey the jumping, preferably a selection means is provided by means of which equipment functions assigned to the display elements can be selected for continued equipment operation.

According to one preferred embodiment of the program-controlled entertainment and game device according to the invention a means is provided for coin/currency input, checking and return.

The program-controlled entertainment and game device according to the invention is preferably used as a money gaming device. The practical configuration-can for example be such that a conventional money gaming device is displayed on the screen and is operated by means of the controls assigned to the housing according to the invention in the conventional manner. For this reason it can also have turntables and/or rollers in the conventional manner.

For interactive game operation it is especially advantageous if there is a game of risk which, when using already achieved winnings, increases the latter with the danger of loss, with a risk ladder which can be displayed on the display device consisting of several display elements which are individual to the winnings. While playing for example the risk ladder can be changed; it is possible to jump back and forth, depending on the winnings constellation which is instantaneously presented. Thus a symbol or special game means can also be provided. Furthermore the money gaming device according to the invention can include a lottery unit with a separate display field which can be optically emphasized in the presence of a randomly controlled or stipulated event, in which with optical emphasis at least the next riskable winnings can be risked game-controlled without danger or loss.

To facilitate game operation a selection means can be provided by which subsequent game operation can be executed on selected game device elements and the selected game device elements are shown enlarged.

Another preferred use of the program-controlled entertainment and game device according to the invention consists in use as an automatic merchandise prize device. In automatic devices of these type the merchandise is offered with certain values and delivered according to the game result achieved.

Another preferred use of the program-controlled entertainment and game device according to the invention is moreover its use as an automatic skill game. Here as well numerous game versions apply, by which the inducement to play for skill players is extraordinarily increased. Here it must be considered that on the one hand the combination and selection possibilities for the player are far greater than usual. On the other hand the equipment reaction is somewhat accelerated compared to currently used automatic devices.

One preferred embodiment of the automatic games of skill according to the invention is made as a shooting simulator in which the display unit has a screen which is used as the firing field and a camera which is connected to a storage and evaluation unit and which scans visible hits produced with an optical firearm on the screen. Here display of the evaluation simultaneously with the firing field is feasible. Shooting simulations are then enabled in a manner which is interesting to the players.

Furthermore, in automatic games of skill according to the invention there is advantageously an evaluation system for game operation with several players such that the evaluation display of the players playing at the time and/or all players is presented. Inducement to play is greatly increased by the simultaneous display.

BRIEF DESCRIPTION OF THE DRAWING

The invention is further explained below using the following description of several embodiments and the drawings, in which.

DESCRIPTION OF THE PREFERRED EMBODIMENTS

The entertainment and game device according to the invention can be built in a number of embodiments. They include:

- a stand-alone device,
- a stand-alone device with long distance data transmission, for example, to an external server or an external evaluation system,
- a networked equipment configuration with a local server and a long distance data transmission link to an external server or external evaluation system, and
- a networked equipment configuration in an association of game-room networks which are connected via a long distance data transmission link to a server or external evaluation system.

Figure 1:
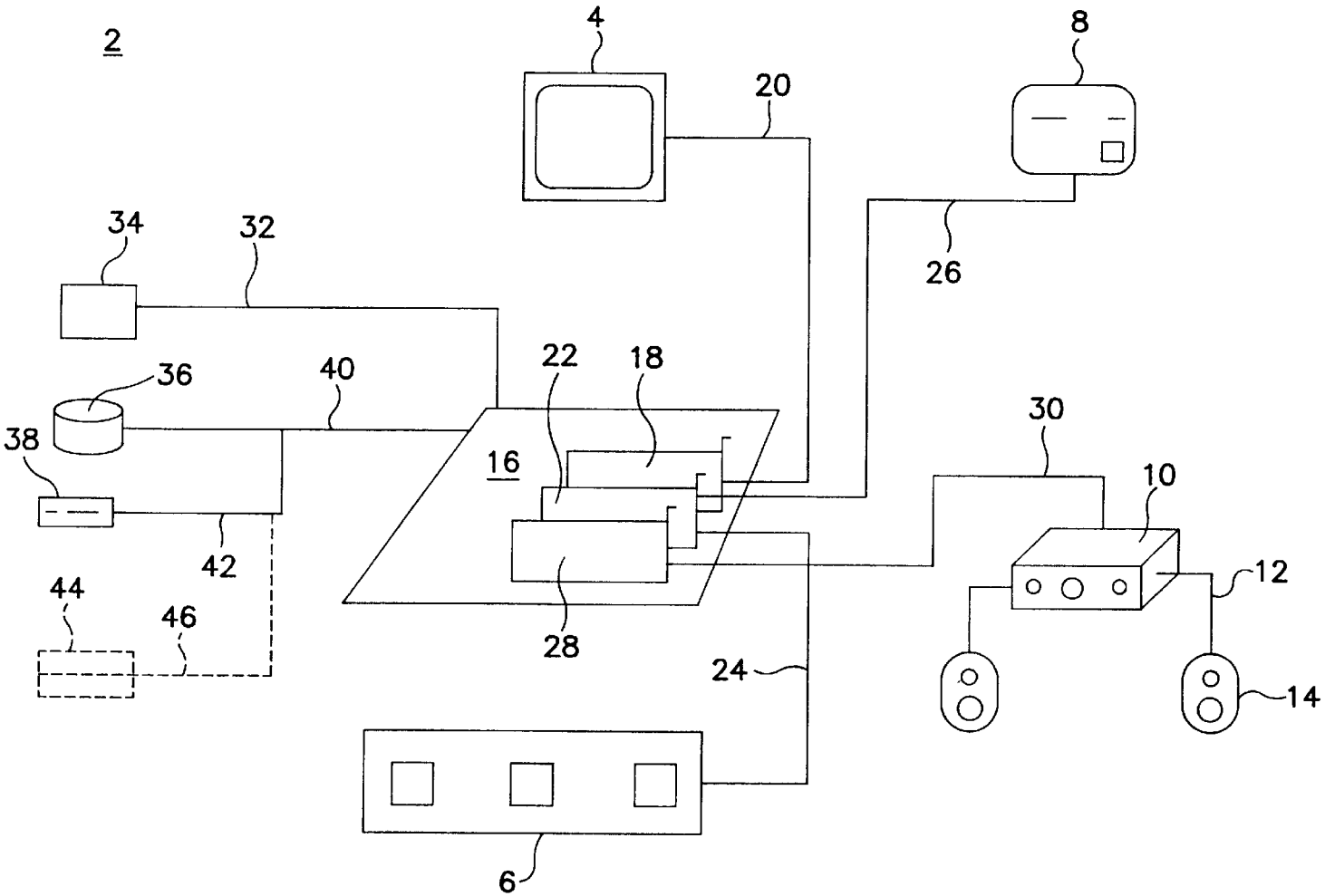
FIG. 1 shows a schematic view which illustrates the basic structure of a first embodiment of a program-controlled entertainment and game device according to the invention.
Figure 2:
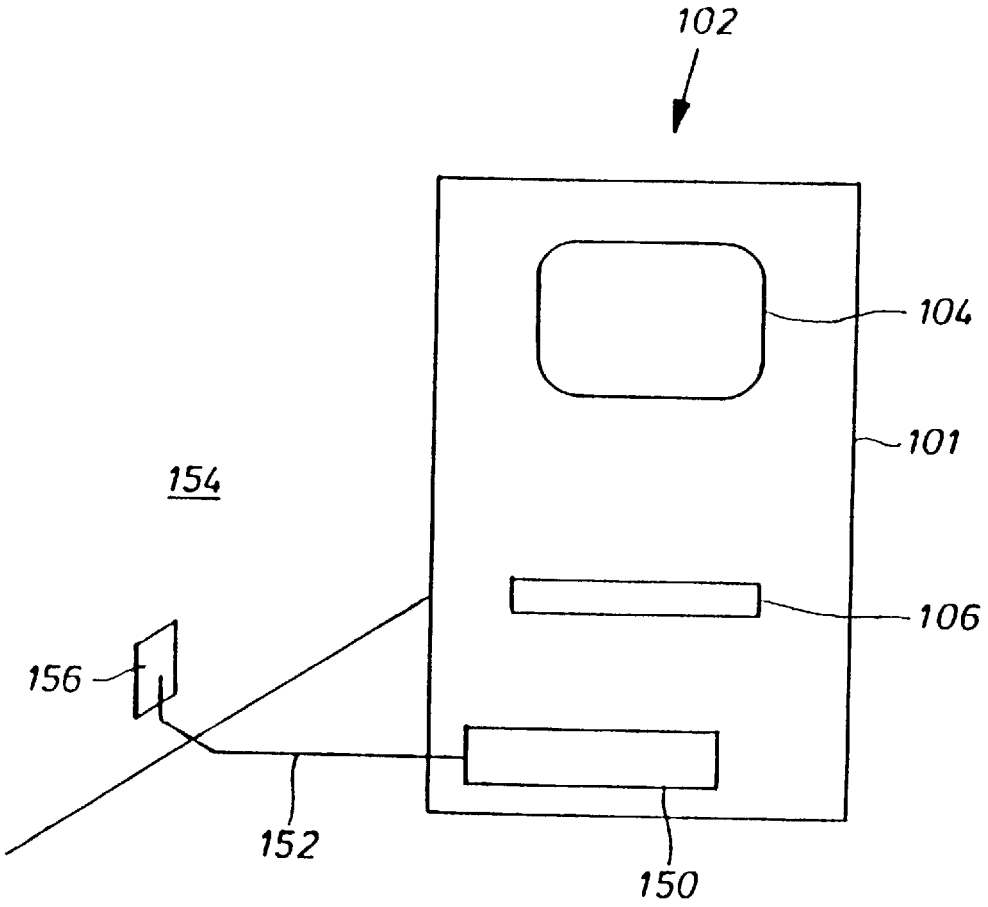
FIG. 2 shows a second embodiment of a program-controlled entertainment and game device according to the invention.
Figure 3:
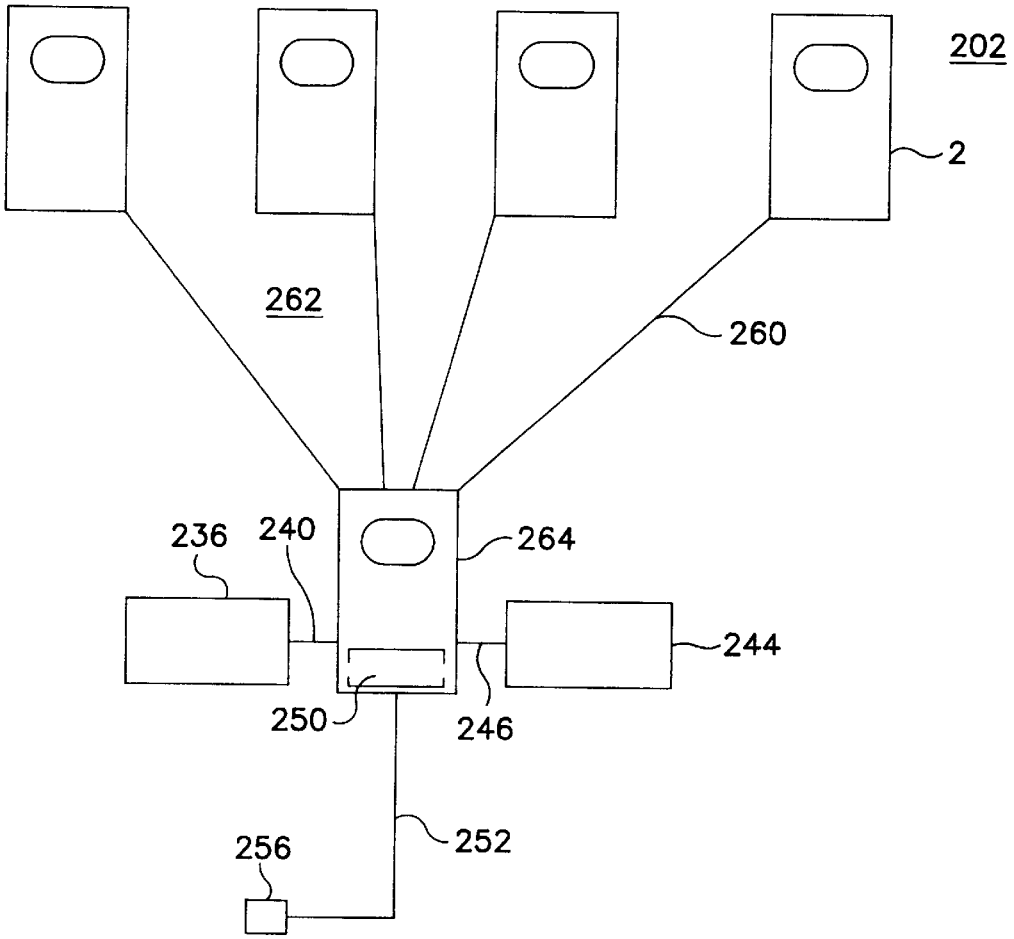
FIG. 3 shows a third embodiment of a program-controlled entertainment and game device according to the invention.

FIGS. 1 through 3 show the first three of the aforementioned versions.

First the basic structure of a program-controlled entertainment and game device according to the invention is explained using the embodiment in FIG. 1. Entertainment and game device 2 which is shown is a coin-operated stand-alone device. It comprises a housing which is not shown, to which is connected display 4 in the form of a screen, for example, a VGA monitor. Furthermore, controls 6 in the form of an input keyboard are connected to the housing. Such an input keyboard has keys which serve as manually operable control members. Coin processing unit 8 is provided for coin game operation. Furthermore an acoustic output display and support unit is connected to the device and comprises stereo amplifier 10 and speaker 14 connected to it via two connecting lines 12.

On system board 16 is the control unit which can be a conventional system card. It is provided with DVI card 18, in which DVI "digital video interactive" is a trademark of Intel Corporation, USA. The DVI card is connected via line 20 to display 4. I/O module 22 is connected via line 24 to controls 6 and via line 26 to coin processing unit 8. A sound card, so-called sound board 28, is connected via line 30 to stereo amplifier 10.

System board 16 is connected via supply line 32 to power pack 34. A memory means assigned to the housing includes hard disk 36 and diskette station 38 or diskettes which are connected to system board 16 via lines 40 or 42. Optionally CD-ROM 44 shown by the broken line can be provided; it is connected to system board 16 via line 46 which is likewise shown by a broken line.

As follows from the aforementioned equipment structure the entertainment and game device according to the invention is suited for extraordinarily flexible operation based on its capacity to combine graphics, still and moving pictures and an audio part using a single computer.

For the equipment function or version desired at the time only one corresponding program with the pertinent data need be read into the memory means. The device then functions according to this new function stipulation.

FIG. 2 shows a second embodiment of entertainment and game device 102 according to the invention which is likewise executed as a stand-along device. On the front side, screen 104 which is used as a display is built into housing 101 of device 102. Underneath display 104 there are controls 106. Underneath controls 106 is modem 150 which is connected to a long distance transmission line via line 152 and Datex-P-access jack 156 which is located in wall 154.

This embodiment of the entertainment and game device according to the invention can thus be operated in conjunction with an external server or an external evaluation system. The server or evaluation system is a computer which is operated by the installer and which makes contact via the long distance data transmission link with the computers of the individual game rooms and monitors the individual devices or undertakes their evaluation. It is also possible to overplay new software onto the local hard disks of the server itself.

FIG. 3 shows a third embodiment of program-controlled entertainment and game device 202 according to the invention. It is a networked equipment configuration with a local server and long distance data transmission link to an external server or external evaluation system.

Several devices 2 are connected via lines 260 or network 262 to local server 264. Server 264 is connected via line 240 to hard disks 236. Furthermore CD-ROM 244 is connected to local server 264 via line 246. Server 264 contains modem 250 which is connected via line 252 to long distance data transmission connection 256.

Of course, the invention is not limited to the described embodiments. It also includes other embodiments and partial combinations of the claimed and/or described features.

What is claimed is:

1. A program-controlled entertainment and game device for use with a server, comprising:

a housing (101), a display unit (4, 104) which is connected to housing (101) or which is provided in it, controls (6; 106) assigned to housing (101), a control unit (16, 18, 22, 28) providing in housing (101), memory means (36, 38, 44; 236, 244) which is assigned to the housing in which application program information is stored, the memory means being re-programmable each time for storage of program and data information for a respective function configuration, only one game being stored at a time in the entertainment and game device; and means for linking the program-controlled entertainment and game device to the server to receive games for storage in the memory means.

2. A program-controlled entertainment and game device according to claim 1, wherein the memory means (36, 38, 44) is connected to the housing.

3. A program-controlled entertainment and game device according to claim 1, wherein the memory means comprises a disk (36; 236).

4. A program-controlled entertainment and game device according to claim 1, further comprising one or more CD-ROMs (44) that are provided as data media in the housing.

5. A program-controlled entertainment and game device according to claim 1, further comprising several CD-ROMs that are provided as data media, and a CD ROM magazine for storing and reading the data media.

6. A program-controlled entertainment and game device according to claim 1, wherein the memory means includes one or more EPROMs.

7. A program-controlled entertainment and game device according to claim 1, wherein the memory means comprises a diskette drive (38).

8. A program-controlled entertainment and game device according to claim 1, wherein the means for linking comprises a long distance data transmission line.

9. A program-controlled entertainment and game device according to claim 1, wherein the program-controlled entertainment and game device is connected to a network (262).

10. A program-controlled entertainment and game device according to claim 1, wherein the program-controlled entertainment and game device is assigned to an evaluation unit or connected to it by the means for linking.

11. A program-controlled entertainment and game device according to claim 1, wherein the controls comprise a keyboard (6), a touchscreen or touchpanel, a laser bean, a joystick and/or a mouse.

12. A program-controlled entertainment and game device according to claim 1, wherein the display unit comprises a screen, and wherein at least one of the controls is provided on the screen.

13. A program-controlled entertainment and game device according to claim 1, wherein the control unit comprises a control board that is assigned to the device.

14. A program-controlled entertainment and game device according to claim 1, wherein at least some of the controls are provided in a remote control unit.

15. A program-controlled entertainment and game device according to claim 1, wherein the controls are voice-controlled.

16. A program-controlled entertainment and game device according to claim 1, wherein the display unit includes a large screen projection display.

17. A program-controlled entertainment and game device according to claim 1, wherein the control unit comprises means by which at least individual areas of the display unit can be selected and can be displayed in a large or small format by computer control.

18. A program-controlled entertainment and game device according to claim 17, wherein it is possible to represent several displays on the display unit at the same time.

19. A program-controlled entertainment and game device according to claim 1, further comprising a selection means by which equipment functions assigned to display elements can be selected for further equipment operation.

20. A program-controlled entertainment and game device according to claim 1, further comprising means (8) for money or card input, checking, debiting and/or return.

21. A program-controlled entertainment and game device according to claim 20, wherein the program-controlled entertainment and game device is a money gaming device.

22. A program-controlled entertainment and game device according to claim 1, further comprising a selection means by which subsequent game operation can be implemented on selected game device elements and the selected game device elements are displayed enlarged.

23. A program-controlled entertainment and game device according to claim 1, wherein the program-controlled entertainment and game device is an automatic merchandise prize device, in which certain values are assigned to the merchandise and the merchandise is delivered according to the game winnings obtained, and wherein the program-controlled entertainment and game device further comprises a magazine for the offered merchandise and an output mechanism for the merchandise to be delivered.

24. A program-controlled entertainment and game device according to claim 1, wherein the program-controlled entertainment and game device is an automatic skill game.

25. A program-controlled entertainment and game device according to claim 24, wherein the skill game is a shooting game in which the display unit has a screen which is used as the firing field, and further comprising a camera which scans the visible hits produced with an optical firearm on the screen.

26. A program-controlled entertainment and game device according to 24, further comprising an evaluation system for game operation with several players such that an evaluation display of the players playing at the time/or all players is represented.

27. A program-controlled entertainment and game device according to claim 1, wherein the memory means comprises a hard disk which stores games received from the server.

28. An entertainment system, comprising a server;

a program-controlled entertainment and game device which is spaced apart from the server and which includes a display unit, at least one manually operable control member, a magnetic storage disk, and a game control unit connected to the display unit, the at least one manually operable control member, and the magnetic storage disk; and means for linking the program-controlled entertainment and game device to the server to receive games for storage on the magnetic storage disk.

29. The entertainment system of claim 28, wherein the magnetic storage disk is a hard disk which stores only one game at a time.

30. The entertainment system of claim 28, wherein the program-controlled entertainment and game device further comprises a money processing unit that is connected to the game control unit to receive money from game players.

* * * * *